US006701538B2

(12) United States Patent
Hunnicutt, Jr. et al.

(10) Patent No.: US 6,701,538 B2
(45) Date of Patent: Mar. 9, 2004

(54) VENTILATING AND DEODORIZING TOILET AND TOILET BOWL VENTILATING AND DEODORIZING APPARATUS

(76) Inventors: Clyde J. Hunnicutt, Jr., 32135 32nd Way SW., Federal Way, WA (US) 98023; George Couture, 3340 S. Dayfield, Milwaukee, WI (US) 53207; Billy McCreary, 8507 N. 60th St., Brown Deer, WI (US) 53223; Earl W. Engle, W. 1098 Cty., Hwy. O, Oconmowoc, WI (US) 53006

( * ) Notice: Subject to any disclaimer, the term of this patent is extended or adjusted under 35 U.S.C. 154(b) by 0 days.

(21) Appl. No.: 10/061,846

(22) Filed: Feb. 1, 2002

(65) Prior Publication Data

US 2003/0145369 A1 Aug. 7, 2003

(51) Int. Cl.[7] ..... E03D 9/04

(52) U.S. Cl. ..... 4/217; 4/213

(58) Field of Search ..... 4/213, 217

(56) References Cited

U.S. PATENT DOCUMENTS

| | | | | | |
|---|---|---|---|---|---|
| 3,887,949 | A | * | 6/1975 | Osmond | 4/213 |
| 3,944,403 | A | * | 3/1976 | Simpson et al. | 96/131 |
| 4,853,981 | A | * | 8/1989 | Hunnicutt, Jr. | 4/213 |
| 5,161,262 | A | * | 11/1992 | Quaintance, Sr. | 4/213 |
| 5,488,741 | A | | 2/1996 | Hunnicutt, Jr. | |
| 5,896,591 | A | * | 4/1999 | Horan et al. | 4/213 |
| 6,052,837 | A | * | 4/2000 | Norton et al. | 4/213 |
| 6,233,750 | B1 | * | 5/2001 | Donald et al. | 4/213 |
| 6,313,371 | B1 | * | 11/2001 | Conant et al. | 604/359 |

* cited by examiner

*Primary Examiner*—Henry Bennett
*Assistant Examiner*—Amanda Flynn
(74) *Attorney, Agent, or Firm*—Parsons & Goltry; Robert A. Parsons; Michael W. Goltry

(57) ABSTRACT

A toilet includes a toilet bowl having a rim bounding a mouth. An attached toilet seat confronts the rim and an attached odor collector is capable of being activated moving air from the toilet bowl through the mouth and deodorizing the air. Shield structure between the rim and the toilet seat inhibits air from transferring between the toilet seat and the rim and channels air from the toilet bowl to the odor collector. A sensor is capable of sensing objects and activating the odor collector in response thereto.

7 Claims, 9 Drawing Sheets

FIGURE 6
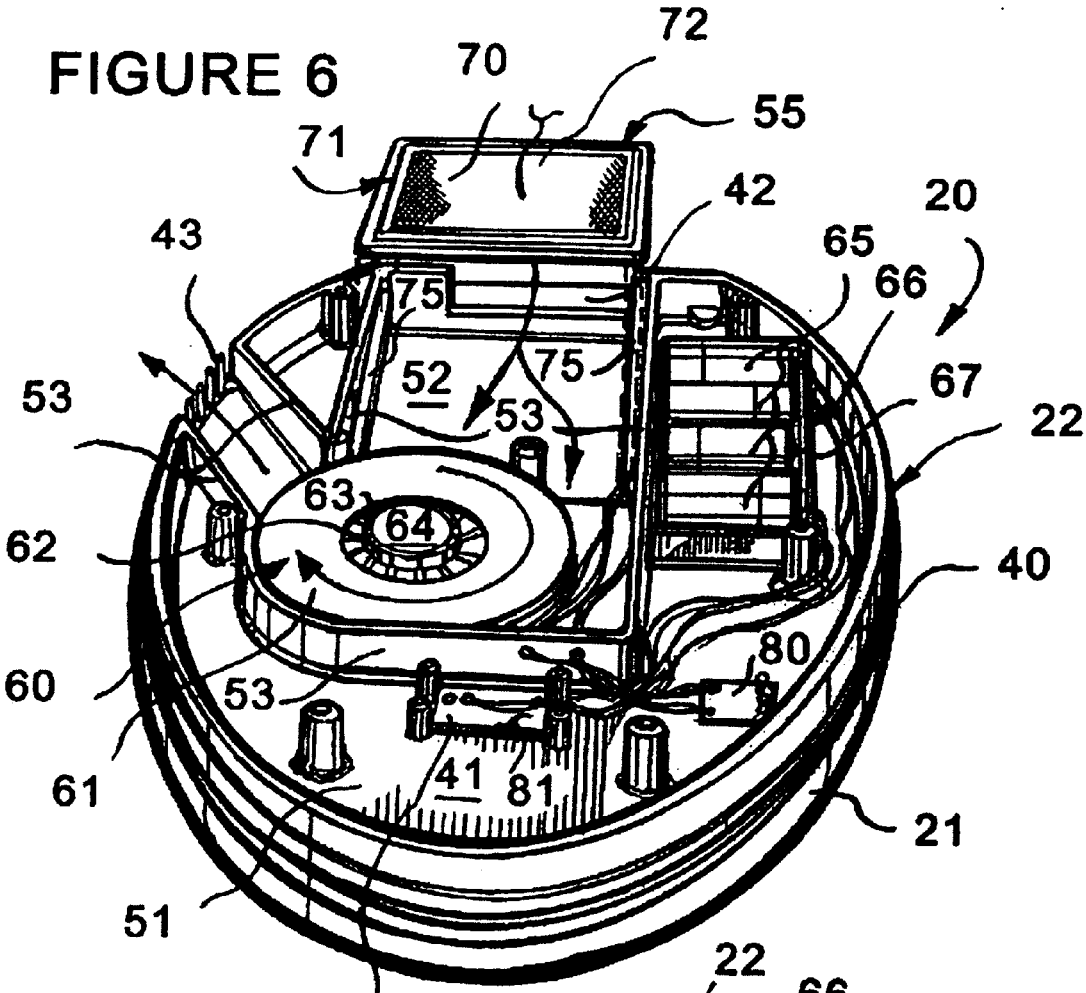
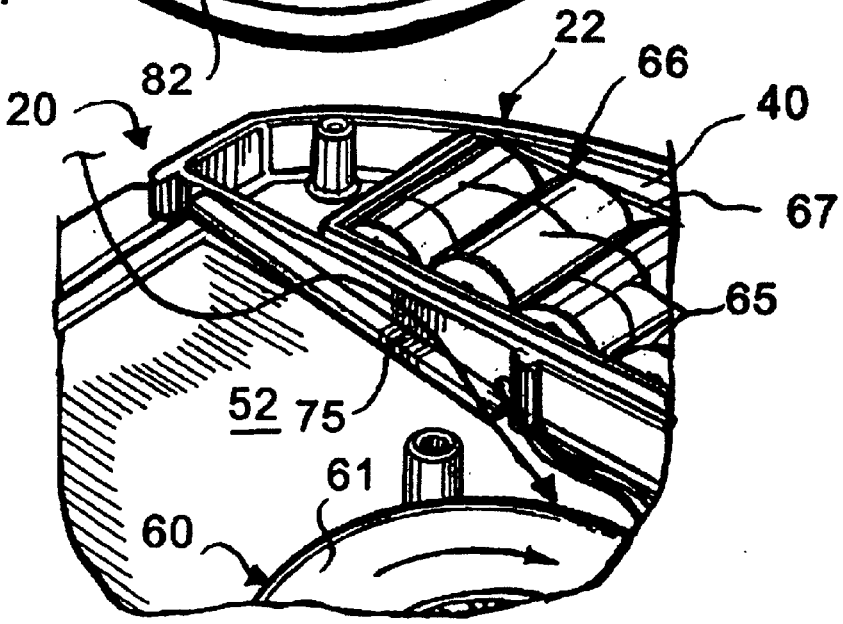
FIGURE 7

VENTILATING AND DEODORIZING TOILET AND TOILET BOWL VENTILATING AND DEODORIZING APPARATUS

FIELD OF THE INVENTION

This invention relates to devices for cleaning air and, more particularly, air cleaning devices in close association with toilets for eliminating malodor.

BACKGROUND OF THE INVENTION

Most people have considered their excremental functions private, and reserve these events to small closed rooms. While private, these small rooms lack the cleansing breezes of a more natural setting. Attempts to compensate for this deficiency include windows and ventilating fans. Because sulfur is capable of counteracting malodor, methods have been employed using sulfur. Some of the simpler methods include lighting matches and candles.

While effective, these techniques are not always possible. Many times, the toilets are placed with no access to the outside. In these situations, ducting is required to exchange fresh air with the tainted air. This can be expensive and the ventilation may be slow since the offensive odor is diffused throughout the room and generally evacuated through a small duct. This is less than ideal, since persons in the room will be subjected to the offensive malodor for prolonged periods of time. Other situations that do not permit open windows or the use of matches is in the very small rest rooms of airplanes. Obviously, windows cannot be opened and federal regulations prohibit the use of matches in airplane rest rooms. Furthermore, the odoriferous air cannot simply be vented outside the aircraft, and certainly cannot be vented into the passenger compartment.

To overcome the problems associated with venting the closed rooms, commonly referred to as bathrooms, containing the toilet, devices directly associated with the toilet have been developed which filter the malodor from the air. Typically, many of the various devices require extensive modifications to be made to the toilet, or a toilet constructed to specification in order to remove the odiferous air. These modifications include specially constructed toilet seats with air passages, lids and/or bowls.

After the foul air is drawn from the bowl, it is then necessary to provide treatment devices packaged in a manner that will not detract from the decor of the bathroom. No matter how attractively the exhaust and deodorizing devices are housed, they remain a distraction and are often a nuisance. Generally, these devices are not esthetically pleasing, being large bulky and positioned on the floor next to the toilet. These devices, so placed are tasteless and detract from the overall decor of a bathroom as well being obstructive. Many require an electrical outlet as a power source, which may or may not be conveniently to hand.

Given these and other deficiencies in the art, there is a need for a new and useful ventilating and deodorizing toilet, and new and useful ventilating and deodorizing apparatus for use with toilets that, among other things, are easy to construct, easy to install with toilets, simple to maintain, energy efficient, and easy to replace.

SUMMARY OF THE INVENTION

The above problems and others are at least partially solved and the above purposes and others realized in a toilet including a toilet bowl having a rim bounding a mouth. An attached toilet seat confronts the rim and an attached odor collector is capable of moving air from the toilet bowl through the mouth and deodorizing the air. Shield structure is disposed between the toilet seat and the rim inhibiting air from transferring between the toilet seat and the rim and channeling air from the toilet bowl to the odor collector. The odor collector includes an inlet disposed proximate the mouth of the toilet bowl and an outlet, an impeller disposed between the inlet and the outlet, an air flow path between the inlet and the impeller, a filter disposed at the air flow path between the inlet and the impeller, a power source capable of supplying power to the impeller, and a switch capable of activating the impeller. The filter is a framework supporting charcoal cloth material. The toilet seat is pivoted, either to the seat or to the odor collector, between a first position confronting the rim and a second position away from rim. The shield structure is carried by the toilet seat, but it can be carried by the rim of the toilet if desired. Preferably, the switch is a sensor that is capable of sensing objects and activating the impeller in response thereto. A pivoted lid is also provided, which is capable of pivoting between a first position away from the toilet seat and a second position toward the toilet seat. In a particular embodiment, the odor collector is carried by the lid.

BRIEF DESCRIPTION OF THE DRAWINGS

Referring to the drawings:

FIG. 6 is a perspective view of the toilet seat assembly of FIG. 1, with portions of a housing of the odor collector removed for the purpose of illustration;

FIG. 7 is a fragmented perspective view of the odor collector as depicted in FIG. 6 illustrating attached batteries;

DETAILED DESCRIPTION OF A PREFERRED EMBODIMENT

Figure 1:
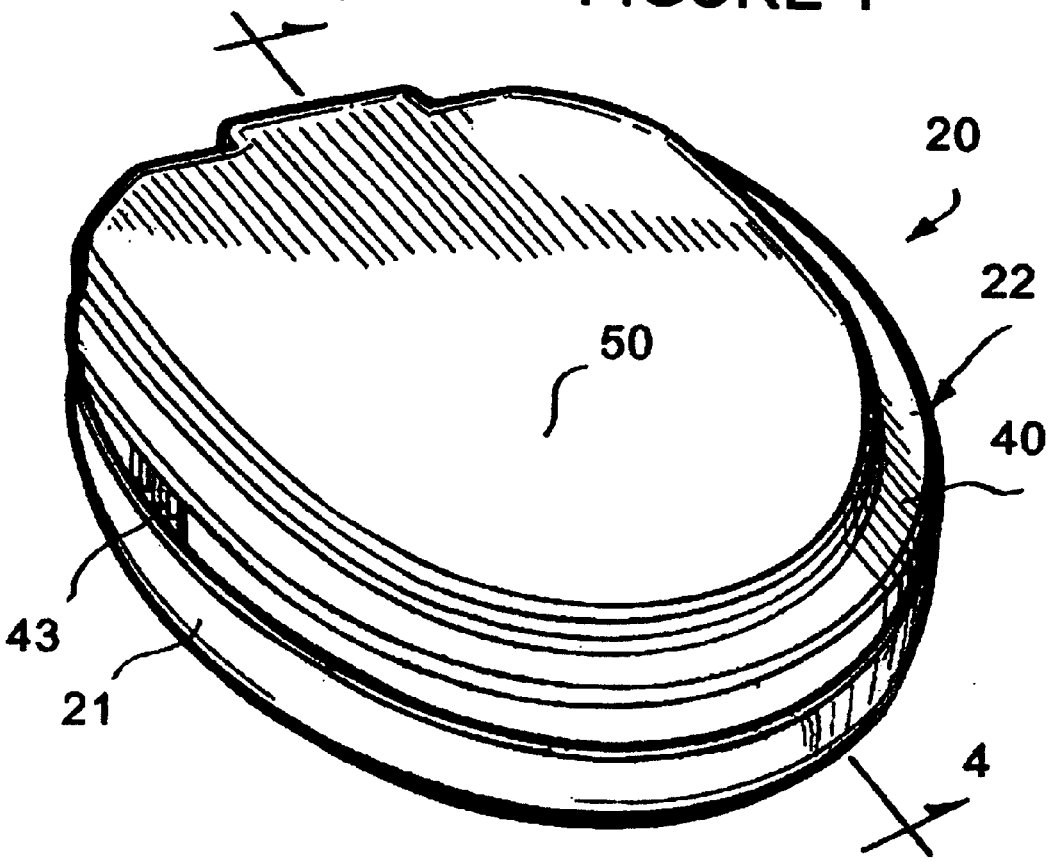
FIG. 1 is perspective view of a toilet seat assembly, in accordance with the principle of the invention, the toilet seat assembly including a toilet seat and a pivoted odor collector that also acts as a lid.

Turning now to the drawings, in which like reference characters indicate corresponding elements throughout the several views, attention is first directed to FIG. 1 in which is seen a toilet seat assembly, embodying the principle of the instant invention, generally indicated by the reference character 20 including a toilet seat 21 pivoted to an odor collector 22, which is also a lid for toilet seat 21. Assembly 20 is capable of being attached to a toilet, which is substantially any toilet of a type including a base supporting a toilet bowl having a front, a back and a rim that bounds a mouth into the interior of the toilet bowl. Assembly 20 is to be attached to the toilet at the back thereof by hinges. This hinge arrangement permits seat 21 and collector 22 to be lowered to a horizontal position with respect to the rim of the toilet bowl, i.e., toward the rim of the toilet bowl, and raised to an upright position with respect to the rim, i.e., away from the rim of the toilet bowl. The movement of seat 21 and collector 22 is accomplished independently. As with a conventional toilet, a water tank extends upward at the back of the toilet bowl. Although not explicitly illustrated by way of a drawing figure, a pair of threaded hinge posts is capable of being affixed to toilet bowl by inserting the threaded ends through openings in the toilet bowl and securing them with nuts. A hinge 25 attaches to the hinge posts, to seat 21 and to collector 22. Hinge 25 is a pin that passes between the hinge posts through a set of seat hinges 30 (FIG. 5) and a set of lid hinges 31 (FIG. 3) so that seat 21 and collector 22 may be independently pivoted thereabout. This hinge arrangement is an example of a useful and simple hinge arrangement, and is not provided as a limitation on the invention. When assembly 20 is so attached to the toilet, collector 22 is capable of moving malodorous air from the toilet bowl through the mouth thereof and deodorizing the malodorous air, regardless of whether collector 22 is disposed toward the rim of the toilet bowl or away from the toilet bowl.

Figure 2:
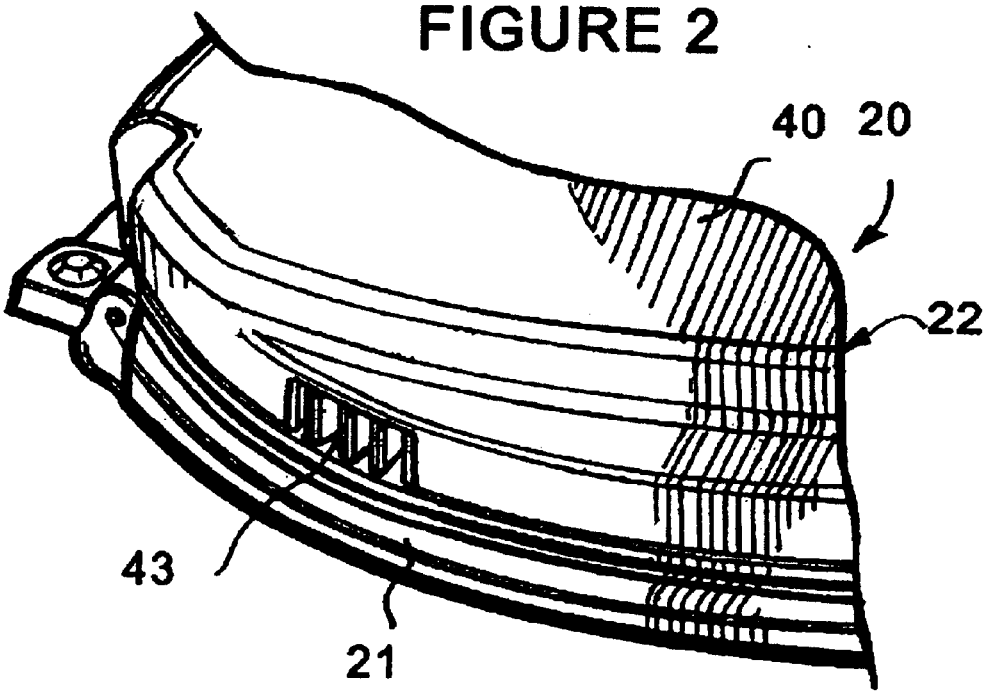
FIG. 2 is an enlarged fragmented perspective view of the toilet seat assembly of FIG. 1.
Figure 4:
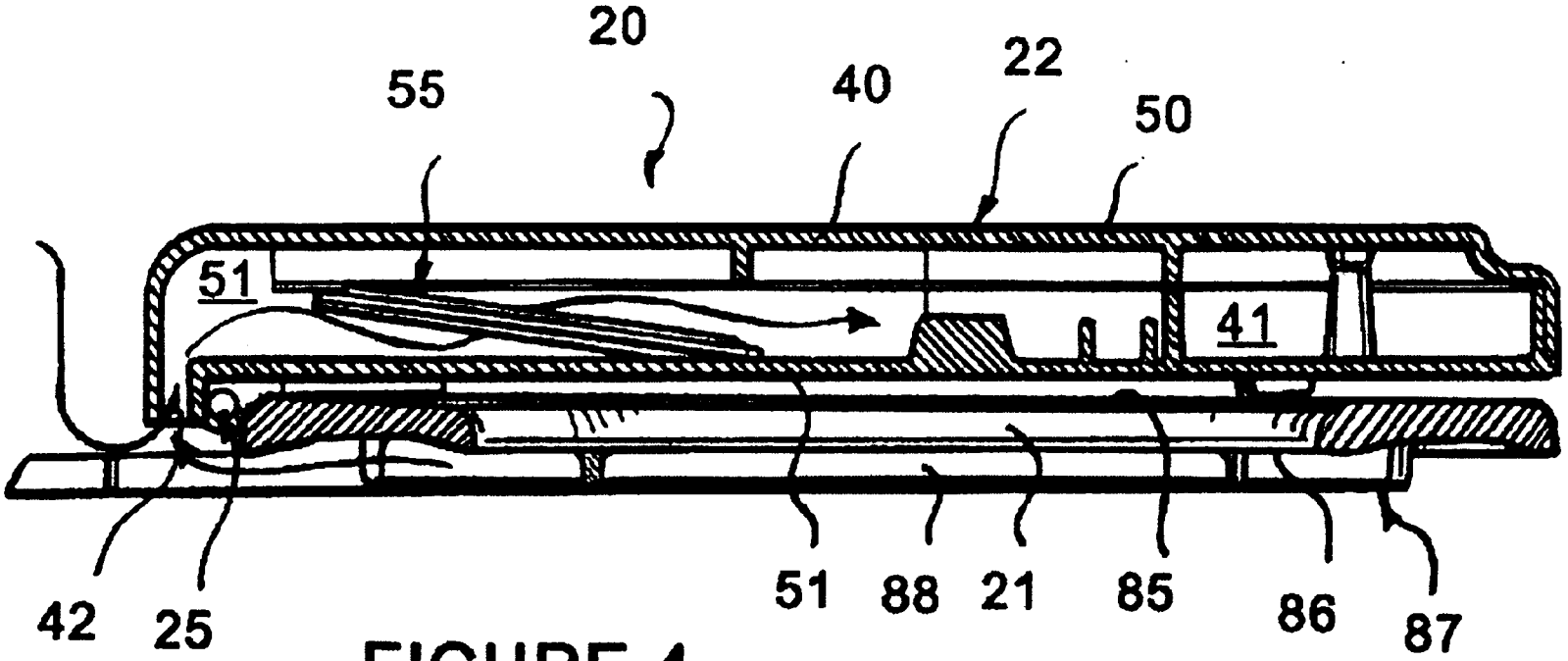
FIG. 4 is a sectional view taken along line 4—4 of FIG. 1.

As shown in FIG. 1, collector 22 includes a housing 40 that in shape and form resembles a typical toilet lid. Referring to FIG. 4, which is a sectional view taken along line 4—4 of FIG. 1, housing 40 bounds a chamber 41 and defines an inlet 42, which is directed generally toward seat 21 and disposed adjacent hinge 25, and an outlet 43 (FIGS. 1,2), which is disposed along a portion of the outer edge of housing 40. Outlet 43 can be disposed elsewhere. For the purpose of orientation, housing 40 includes a top 50 disposed away from seat 21 and a bottom 51 disposed toward seat 21, and FIG. 6 is a perspective view of assembly 20 with top 50 removed for the purpose of illustration. Referring to FIG. 6, inlet 42 and outlet 43 communicate with a duct 52 of chamber 41. Dividing walls 53 delineate duct 52 and are disposed between and engage top 50 (not shown in FIG. 6) and bottom 51 substantially isolating duct 52 from the balance of chamber 41. An attached impeller 60 is disposed within duct 52 between inlet 42 and outlet 43 and an attached filter 55 is disposed within duct 52 between inlet 42 and impeller 60.

Impeller 60 consists of a housing 61 enclosing a fan 62 having a hub 63. A motor 64 positioned in hub 63 drives fan 62. Batteries 65 contained in a battery case 66 affixed to housing 40 in chamber 41 provide motor 64 with power. Battery case 66 (FIGS. 6,7) includes a body or cradle 67 for holding batteries 65. Top 50 (not shown in FIGS. 6,7) closes body 67. Battery case 66 holds four batteries 65, which are preferably D cell batteries, and includes conventional negative and positive terminal contacts for receiving batteries 65, with the negative terminal contacts being compression coils to insure a secure fit and connection. Conventional electrical wiring associated with battery case 66 and motor 64 transfers power between battery case 66 and motor 64. Rotation of fan 62 draws air into duct 52 through inlet 42 from the toilet bowl and expels the air through outlet 43. Because inlet 42 is disposed adjacent hinge 25 (FIG. 4), it is located adjacent the rim of the toilet bowl, which allows it draw air from the toilet bowl through the mouth of the toilet bowl not only when collector 22 is disposed toward the rim but also away from the rim.

With continuing reference to FIG. 6, filter 55 consists of charcoal cloth 70 attached to and held by a framework 71. Framework 71 is fashioned of plastic, aluminum or the like, and is a generally square/rectangular continuous rim 72 that bounds a window 73. Cloth 70 is 100% charcoal in a flexible form and is woven or kitted. Cloth 70 has a high capacity for adsorption of organic vapors and has rapid adsorption kinetics, which permits it to display highly effective adsorption at short contact times and with high airflows.

Duct 52 defines an airflow path between inlet 42 and impeller 60. Filter 55 sits in a seat 75 at duct 52 between inlet 42 and impeller 60 and divides the airflow path. As a result, malodorous air pulled into duct 52 by impeller 60 through inlet 42 from the mouth of the toilet bowl is forced through cloth 70, where malodor is removed from the air, into impeller 60 and expelled through outlet 43. The height of filter 55 is much greater than the height of duct 52. As best depicted in FIG. 4, filter 55 is therefore disposed at a shallow angle in duct 52. The size of filter 55 and its shallow orientation in duct 52 allows a large surface area of cloth 70 to reside in duct 52, as opposed to a smaller filter disposed at a steeper angle or even perpendicularly to the flow of air through the air flow path of duct. In FIG. 4, filter 55 is angled so that air passes into the bottom of filter 55 and out the top of filter. Filter 55 can be angled so that air passes into the top of filter 55 and out of the bottom of filter 55 if desired. Framework 71 supports and maintains cloth 70 in the airflow path defined by duct 52.

Figure 3:
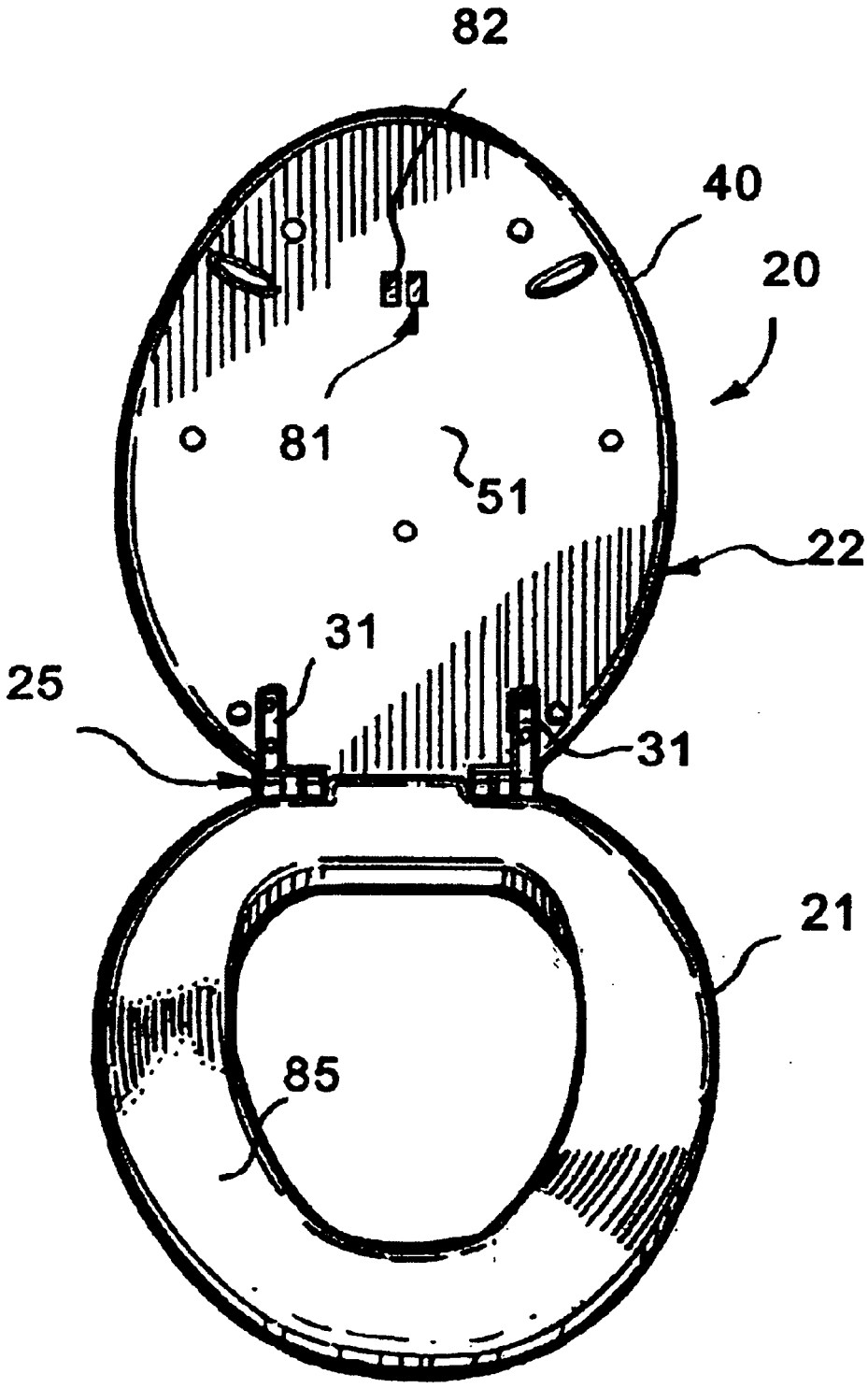
FIG. 3 is a perspective view of the toilet seat assembly of FIG. 1 with the odor collector pivoted away from the toilet seat.
Figure 5:
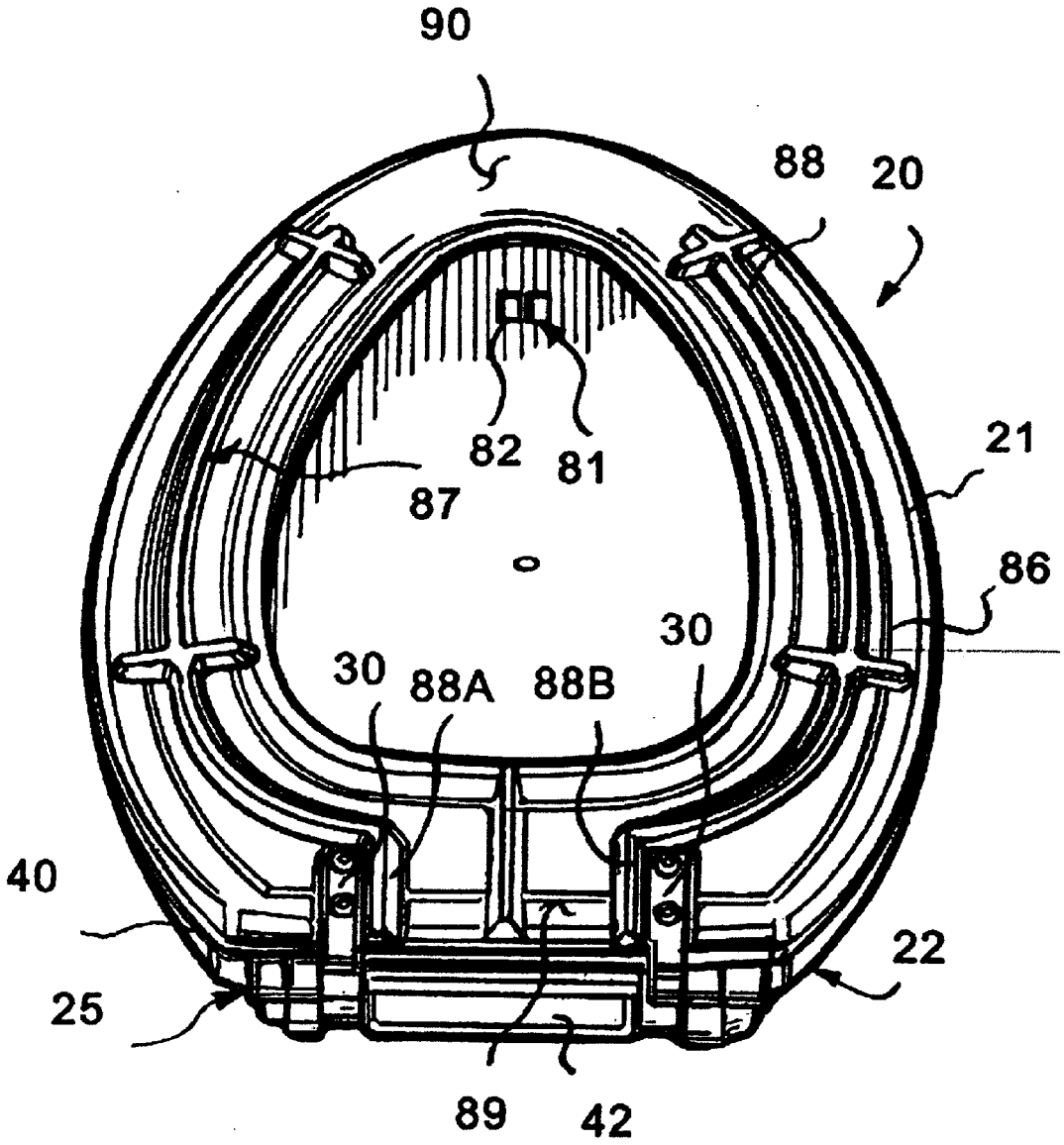
FIG. 5 is a bottom perspective view of the toilet seat assembly of FIG. 1.

Looking to FIGS. 3, 5, and 6, collector 22 is furnished with a controller 80 and a switch 81. Switch 81 is capable of activating impeller 60 collecting and deodorizing malodorous air from the toilet bowl and deactivating impeller 60. Batteries 65 contained in battery case 66 provide controller 80 and switch 81 with power. Conventional electrical wiring associated with battery case 66, controller 80 and switch 81 transfers power between battery case 66 and controller 80 and switch 81. Conventional electrical wiring also couples together controller 80, switch 81 and impeller 60, with controller 80 functioning essentially as the "brains" of collector 22.

Switch 81 is a sensor 82 that is capable of sensing the presence of obstacles confronting it. Sensor 82 toggles between a first condition in response to detecting an obstacle confronting it activating impeller 60 and a second condition in response to it not detecting an obstacle deactivating impeller 60. Sensor 82 is a conventional, readily available device that employs infrared pulses for detecting the presence of obstacles confronting it. Sensor 82 is coupled to bottom 51 of housing 40 and as seen in FIGS. 3 and 5 is exposed exteriorly of bottom 51 facing seat 21. In a manner of using a toilet fashioned with assembly 20, collector 22 is disposed upright with respect to the rim of the toilet and seat 21 is disposed toward the rim of the toilet resting against it, which allows a user to sit upon seat 21 for purpose of voiding into the toilet bowl. When a user is so seated upon seat 21, the back of the user will confront sensor 82. In response to sensing the presence of the user seated upon seat 21, sensor 82 is responsive and activates impeller 60 (i.e., collector 22) collecting and deodorizing malodorous air from the toilet. After the user vacates seat 21 and sensor 82 no longer detects the presence of the user, sensor 82 is responsive and deactivates impeller 82 (i.e., collector 22). This is how collector 22 is operated. Sensor 82 is preferred for activating and deactivating impeller 60, wherein the activation of impeller 60 is considered an activation of collector 22 collecting and deodorizing malodorous air from the toilet. In an appreciate of the scope of the invention, those having ordinary skill will appreciate that other switch forms can be used for activating and deactivating collector 22 including a manual switch, a switch that is responsive to pressure applied against seat 21 by a user seated thereagainst, etc.

In accordance with a preferred embodiment of the invention, controller 80 cooperates with sensor 82 and carries out a number of different functions. For instance, after a user vacates seat 21 having voided in the toilet, malodorous air will usually remain in the toilet bowl. Accordingly, controller 80 is programmed or otherwise configured to keep impeller 60 running for a predetermined period of time after sensor 82 no longer detects the presence of the user for the purpose of collecting and deodorizing the balance of the malodorous air from the toilet, regardless of whether controller 22 is upright away from the rim of the toilet or disposed toward the rim of the toilet against seat 21. This predetermined period of time can be any desired period of time, whether five seconds, seven seconds, ten seconds, thirty seconds, one minute, five minutes, etc. After the predetermined period of time has passed, controller 80 deactivates impeller 60. If desired, controller 80 can be programmed to activate impeller 60 only after sensor 82 has continually detected the presence of a user confronting it for five seconds, ten seconds, thirty seconds, or other predetermined period of time. Preferably, sensor 82 is configured to detect an object up to nine inches away but this distance can be less or more depending on specific needs.

Referring to FIG. 3, seat 21 is a generally circular rim having an upper seating surface 85 and an opposing lower surface 86 (FIG. 5), which faces the rim of a toilet to which seat 21 is attached. Regarding FIG. 5, seat 21 supports shield structure 87, which is disposed at lower surface 86. Shield structure 87 is basically a raised wall or shield 88 that projects away from lower surface 86 extending from an end 88A thereof at seat hinge 30 proximate inlet 42 along lower surface 86 and to an end 88B thereof at the other seat hinge 30 proximate inlet 42. A space 89 is defined between ends 88A,88B. A gap 90 is also provided opposite space 89 to allow for the inlet of air into the toilet bowl. When seat 21 is lowered against the rim of a toilet, shield 88 is disposed between seat 21 and the rim and rests against the rim advantageously inhibiting malodorous air from transferring between seat 21 and the rim and channeling malodorous air from the toilet bowl to inlet 42 and thus to collector 22 by way of space 89. Shield structure 87 can, if desired, be attached to and carried by the rim of the toilet if desired, in which it would accomplish its function as if it were attached to and carried by seat 21 as with the immediately depicted embodiment.

Figure 8:
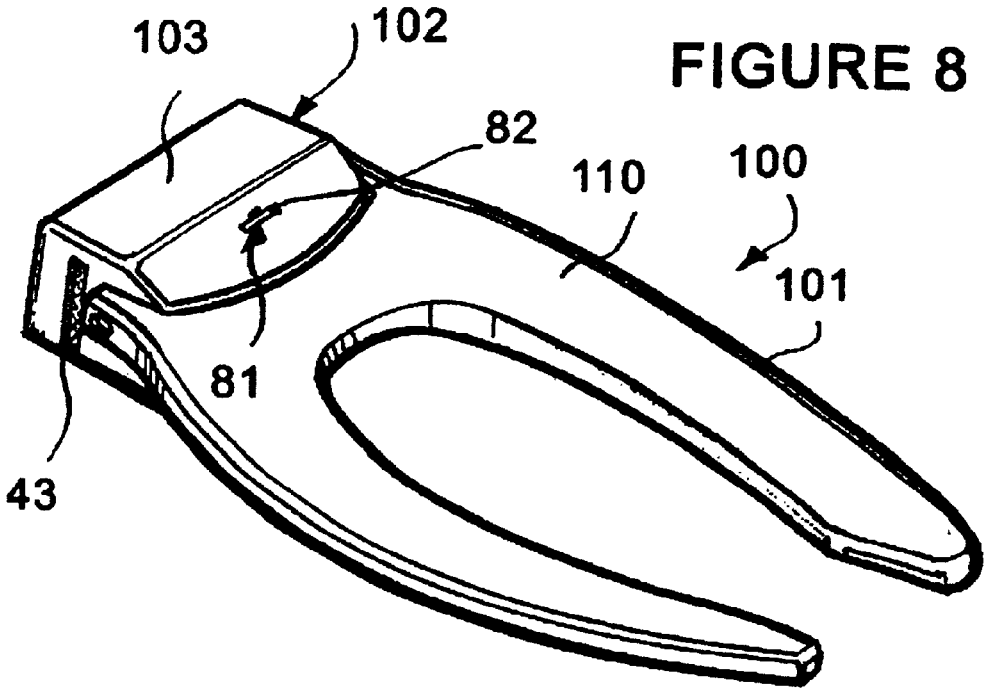
FIG. 8 is perspective view of an alternate embodiment of a toilet seat assembly, in accordance with the principle of the invention, the toilet seat assembly including a toilet seat pivoted to an odor collector.

Reference is now made to FIG. 8, illustrating a perspective view of an alternate embodiment of a toilet seat assembly 100, in accordance with the principle of the invention, assembly 100 including a toilet seat 101 pivoted to an odor collector 102. Assembly 100 is designed for use with industrial toilets, which, by law, cannot be furnished with a toilet lid. Assembly 100 is capable of being attached to a toilet, which, in accordance with the present embodiment, is substantially any toilet of a type for industrial use including a base supporting a toilet bowl having a front, a back and a rim that bounds a mouth into the interior of the toilet bowl. Collector 102 is to be attached to the toilet at the back thereof with threaded bolts secured by nuts or by means of another suitable manner of attachment. When assembly 100 is so attached to the toilet, collector 102 is capable of moving malodorous air from the toilet bowl through the mouth thereof and substantially deodorizing the malodorous air. Collector 102 can be incorporated into the structure of the toilet if desired. Seat 101 is pivoted to the sides of a housing 103 of collector 102 by way of any suitable hinged structure. This hinge arrangement permits seat 101 to be lowered to a horizontal position with respect to the rim of the toilet bowl, i.e., toward the rim of the toilet bowl, and raised to an upright position with respect to the rim, i.e., away from the rim of the toilet bowl. Seat 101 can be pivoted directly to the toilet if desired, rather than to collector 102. As with a conventional industrial toilet, a dedicated water line communicates with the toilet bowl.

Figure 10:
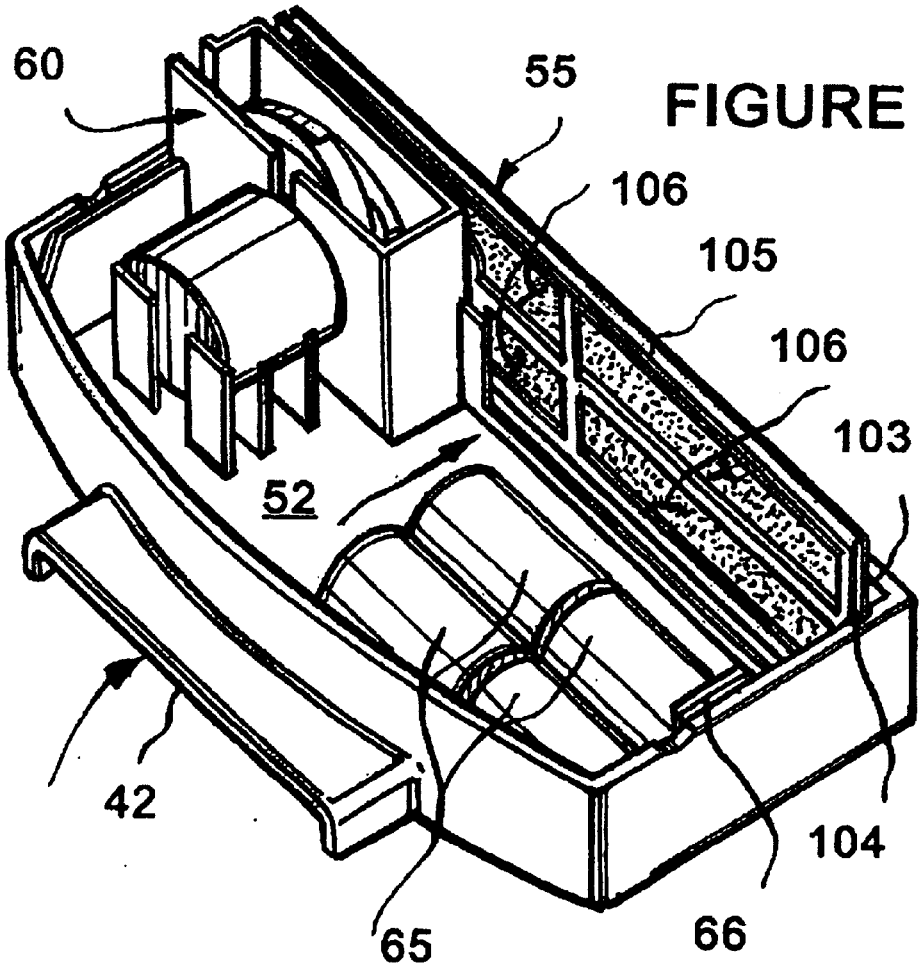
FIG. 10 is a perspective view of the odor collector of FIG. 8 with portions of a housing thereof removed for the purpose of illustration.

In common with the previously described collector designated 22, collector 102, as illustrated in FIG. 10, shares inlet 42, outlet 43 (which is not immediately depicted), duct 52, filter 55, impeller 60, batteries 65 and battery case 66, controller 80 (which is not immediately depicted), and switch 81 (FIG. 8), namely, sensor 82. Sensor 82 is exposed exteriorly of housing 103 facing seat 21 and functions identically to the sensor of collector 22. In this regard, collector 102 functions identically to collector 22, but the foregoing common elements are arranged somewhat differently and housing 103 is not a toilet seat and rather is to be attached as a fixed element to the back of the toilet with inlet 42 disposed proximate the mouth of the toilet bowl. Also, the interior chamber bound by housing 103 constitutes duct 52 and batteries 65 and battery case 66 are attached to housing 103 within duct 52 as is the case with impeller 60.

Duct 52 defines an airflow path between inlet 42 and impeller 60. Filter 55 sits in a seat 104 of housing 103 at duct 52 between inlet 42 and impeller 60 and divides the airflow path. As a result, malodorous air pulled into duct 52 by impeller 60 through inlet 42 from the mouth of the toilet bowl is forced through filter 55 a first time in one direction and then back through filter 55 a second time in an opposing direction, where malodor is removed from the air, into impeller 60 and expelled through an outlet 43. In the embodiment of FIG. 10, the height and width of filter 55 are substantially equal to the height and width of duct 52 as defined by housing 103 and sits perpendicularly relative to the air flow path. Unlike the filter of collector 22, a framework 105 of filter 55 of collector 102 includes a plurality of windows 106 that are each occupied by the charcoal cloth material previously disclosed. Framework 105 supports and maintains the charcoal cloth material in the airflow path. Framework 105 can also be formed so as to fit around impeller 60, requiring the malodorous air to pass through filter 55 only once.

Figure 9:
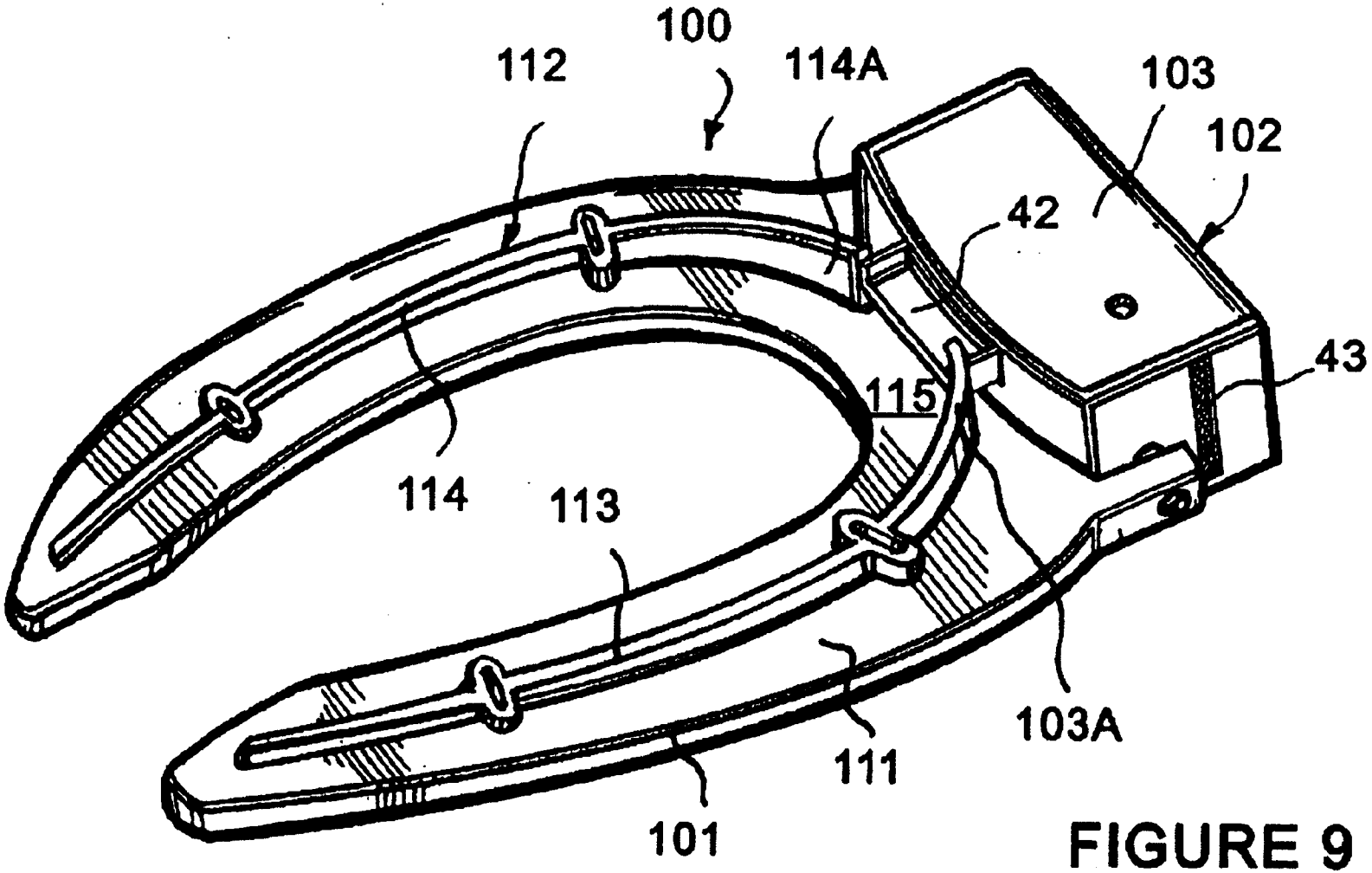
FIG. 9 is a bottom perspective view of the toilet seat assembly of FIG. 8.

Seat 101 of assembly 100 is a generally U-shaped element having an upper seating surface 110 (FIG. 8) and an opposing lower surface 111 (FIG. 9), which faces the rim of a toilet to which seat 101 is attached either directly or by way of collector 102. Regarding FIG. 9, seat 101 supports shield structure 112, which is disposed at lower surface 11. Shield structure 112 constitutes raised walls or shields 113,114 that project away from lower surface 111 extending from ends 113A,114A thereof, respectively, at a rearward end of seat 101 proximate inlet 42 along lower surface 111 of the extremities of seat 101 to the forward end of seat 101. A space 115 is defined between ends 113A,114A. When seat 101 is lowered against the rim of a toilet, shields 113,114 are disposed between seat 101 and the rim and rest against the rim advantageously inhibiting malodorous air from transferring between seat 101 and the rim and channeling malodorous air from the toilet bowl to inlet 42 and thus to collector 102 by way of space 115. Shield structure 112 can, if desired, be attached to and carried by the rim of the toilet if desired, in which it would accomplish its function as if it were attached to and carried by seat 101 as with the immediately depicted embodiment.

Figure 11:
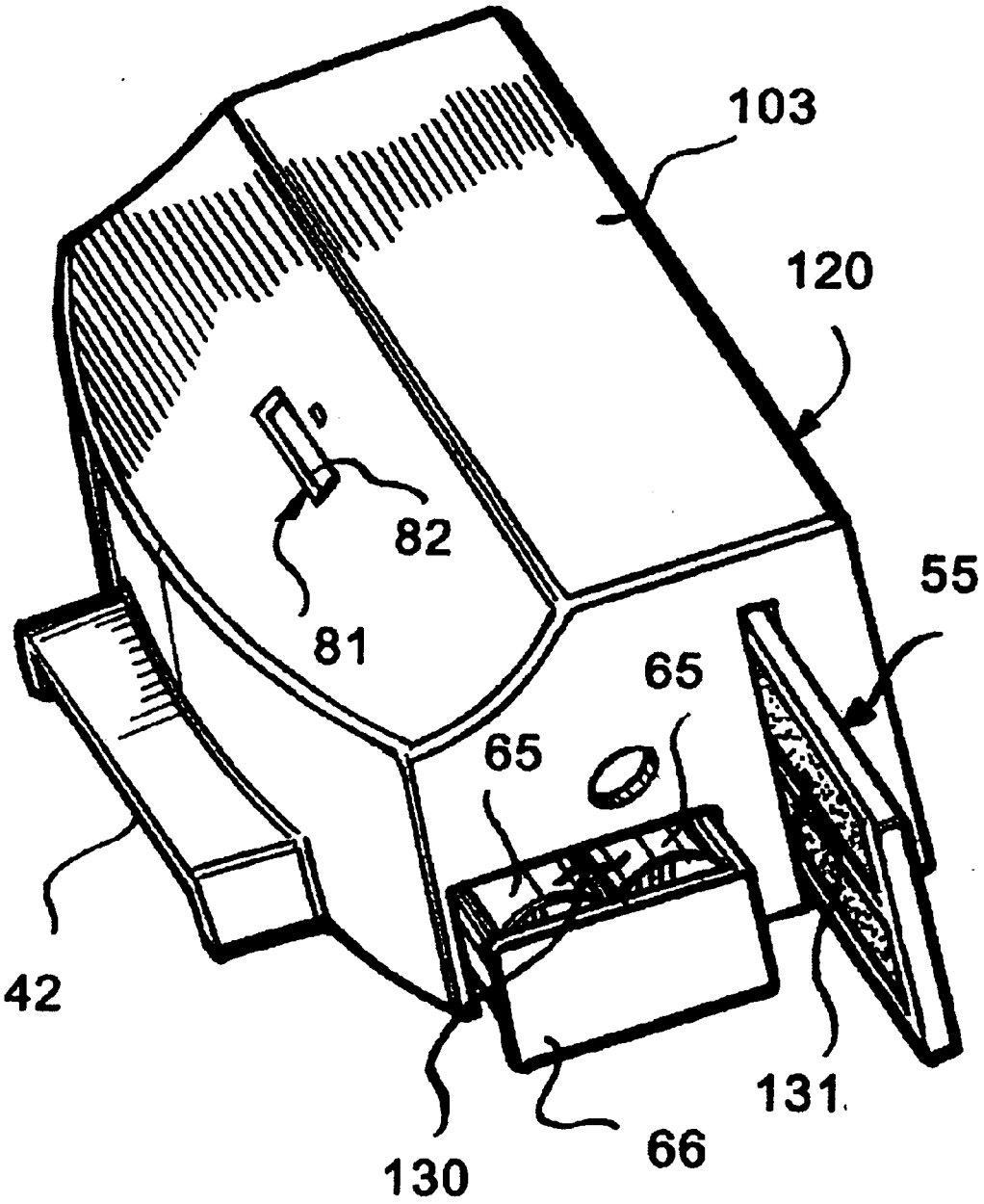
FIG. 11 is a perspective view of yet another embodiment of the invention including an odor collector for use with a toilet seat installation, in accordance with the principle of the invention.
Figure 12:
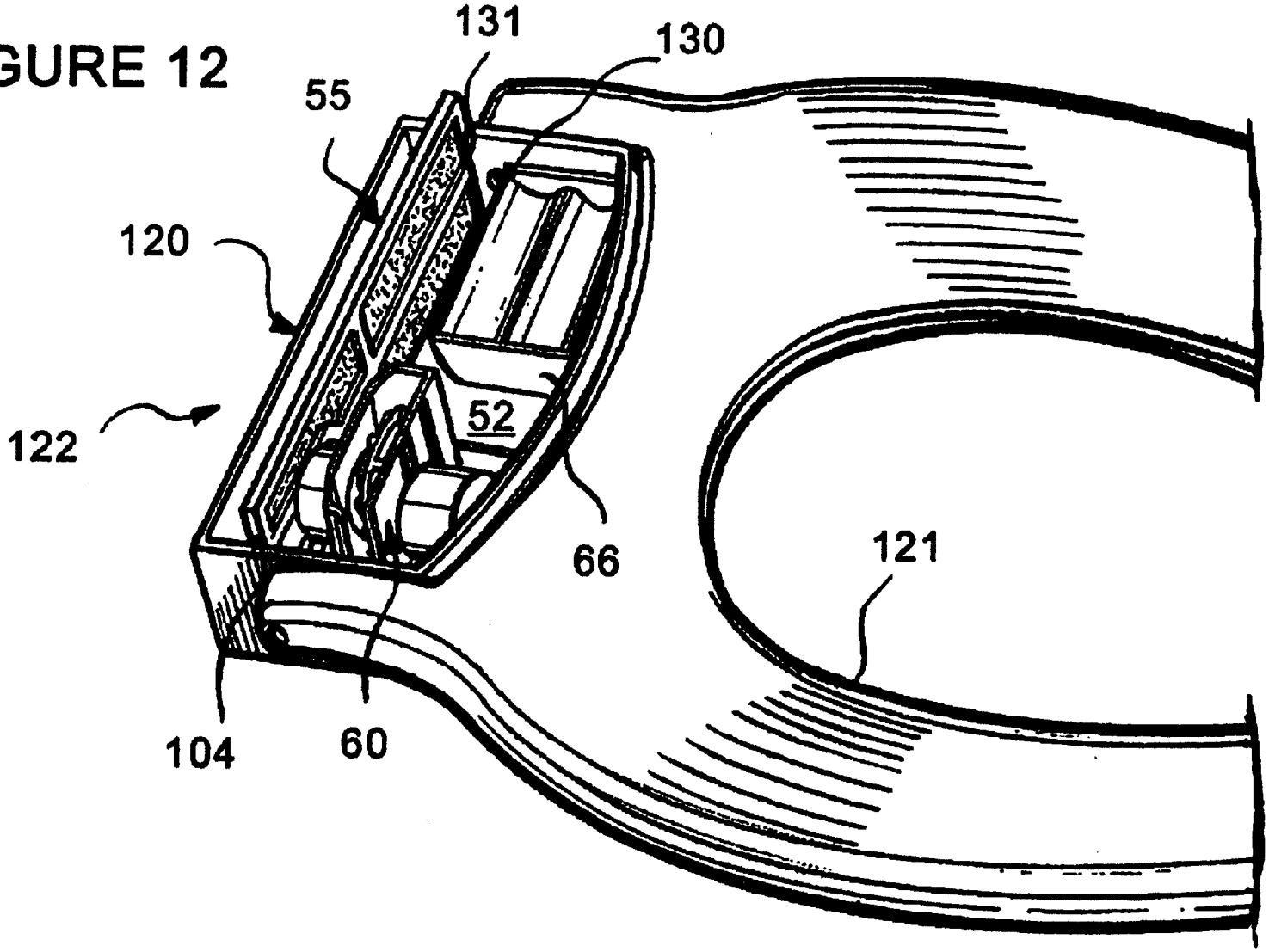
FIG. 12 is a perspective view of the odor collector of FIG. 11 shown as it would appear attached to a toilet seat, with portions of a housing of the odor collector removed for the purpose of illustration.

Reference is now made to FIGS. 11 and 12, illustrating a perspective view of yet another embodiment of the invention including an odor collector 120 for use with a toilet seat installation, in accordance with the principle of the invention. Collector 120 is like that of collector 102, in that it is designed for use with an industrial toilet. FIG. 12 illustrates a toilet seat assembly 122 incorporating collector 120, namely, a toilet seat 121 pivoted to collector 120 in much the same manner as seat 101 is pivoted to collector 102.

In common with the previously described collector designated 102, collector 120, as shares housing 103, seat 104, inlet 42 (FIG. 11), outlet 43 (which is not immediately depicted), duct 52, filter 55, impeller 60, batteries 65 (FIG. 11), battery case 66, controller 80 (which is not immediately depicted), and switch 81 (FIG. 11), namely, sensor 82. Collector 120 functions identically to collector 102 and its various elements are similarly arranged. However, and with reference to FIG. 11, battery case 66 is removable attached to housing 103 and is removable from housing 103 through an opening 130 thereof, permitting battery case 66 to be removed for replacing batteries as the need arises. Like battery case 66, filter 55 is also removable from housing 103 through an opening or slot 131 thereof, permitting filter 55 to be removed for replacement with a new filter as the need arises.

The present invention is described above with reference to preferred embodiments. However, those skilled in the art will recognize that changes and modifications may be made in the described embodiments without departing from the nature and scope of the present invention. Various changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. Apparatus comprising:

a toilet including a toilet bowl, having a rim bounding a mouth;

an attached toilet seat confronting the rim;

an attached odor collector that is capable of moving air from the toilet bowl through the mouth and deodorizing the air, the odor collector including a housing with an air inlet disposed proximate the mouth of the toilet bowl and an air outlet exterior of the toilet bowl, an impeller disposed in the housing between the inlet and the outlet, the housing defining an airflow path between the inlet and the impeller, an air filter mounted within the housing so as to be disposed in the airflow path between the inlet and the impeller, the filter including a rigid flat framework supporting a layer of charcoal cloth, a power source capable of supplying power to the impeller, and a switch capable of activating the impeller; and shield structure disposed between the toilet seat and the rim inhibiting air from transferring between the toilet seat and the rim and channeling air from the toilet bowl to the air inlet of the odor collector.

2. Apparatus of claim 1, wherein the toilet seat is pivoted to the toilet between a first position confronting the rim and a second position away from rim.

3. Apparatus of claim 1, wherein the toilet seat is pivoted to the odor collector between a first position confronting the rim and a second position away from the rim.

4. Apparatus of claim 1, wherein the shield structure is carried by one of the toilet seat and the rim.

5. Apparatus of claim 1, wherein the switch is a sensor that is capable of sensing objects and activating the impeller in response thereto.

6. Apparatus of claim 1, further comprising an attached lid that is capable of pivoting between a first position away from the toilet seat and a second position toward the toilet seat.

7. Apparatus of claim 6, wherein the odor collector is carried by the lid.

* * * * *